United States Patent [19]

Chopra et al.

[11] 3,933,476

[45] Jan. 20, 1976

[54] GRAIN REFINING OF ALUMINUM

[75] Inventors: Kuldip S. Chopra, Grand Island; William D. Forgeng, Niagara Falls; Nicholas J. Pappas, Snyder, all of N.Y.

[73] Assignee: Union Carbide Corporation, New York, N.Y.

[22] Filed: Oct. 4, 1974

[21] Appl. No.: 512,157

[52] U.S. Cl. ..... 75/68 R; 75/93 AC; 75/94; 75/138

[51] Int. Cl.[2] ..... C22C 21/00

[58] Field of Search ..... 75/68 R, 93 R, 93 AC, 94, 75/138

[56] References Cited

UNITED STATES PATENTS

| | | | |
|---|---|---|---|
| 3,592,637 | 7/1971 | Brown et al. | 75/138 X |
| 3,854,935 | 12/1974 | Snow | 75/93 AC |

*Primary Examiner*—L. Dewayne Rutledge
*Assistant Examiner*—M. J. Andrews
*Attorney, Agent, or Firm*—Frederick J. McCarthy

[57] ABSTRACT

Grain refining of aluminum using an addition of titanium, aluminum and $KBF_4$.

6 Claims, 17 Drawing Figures

Figure 1:
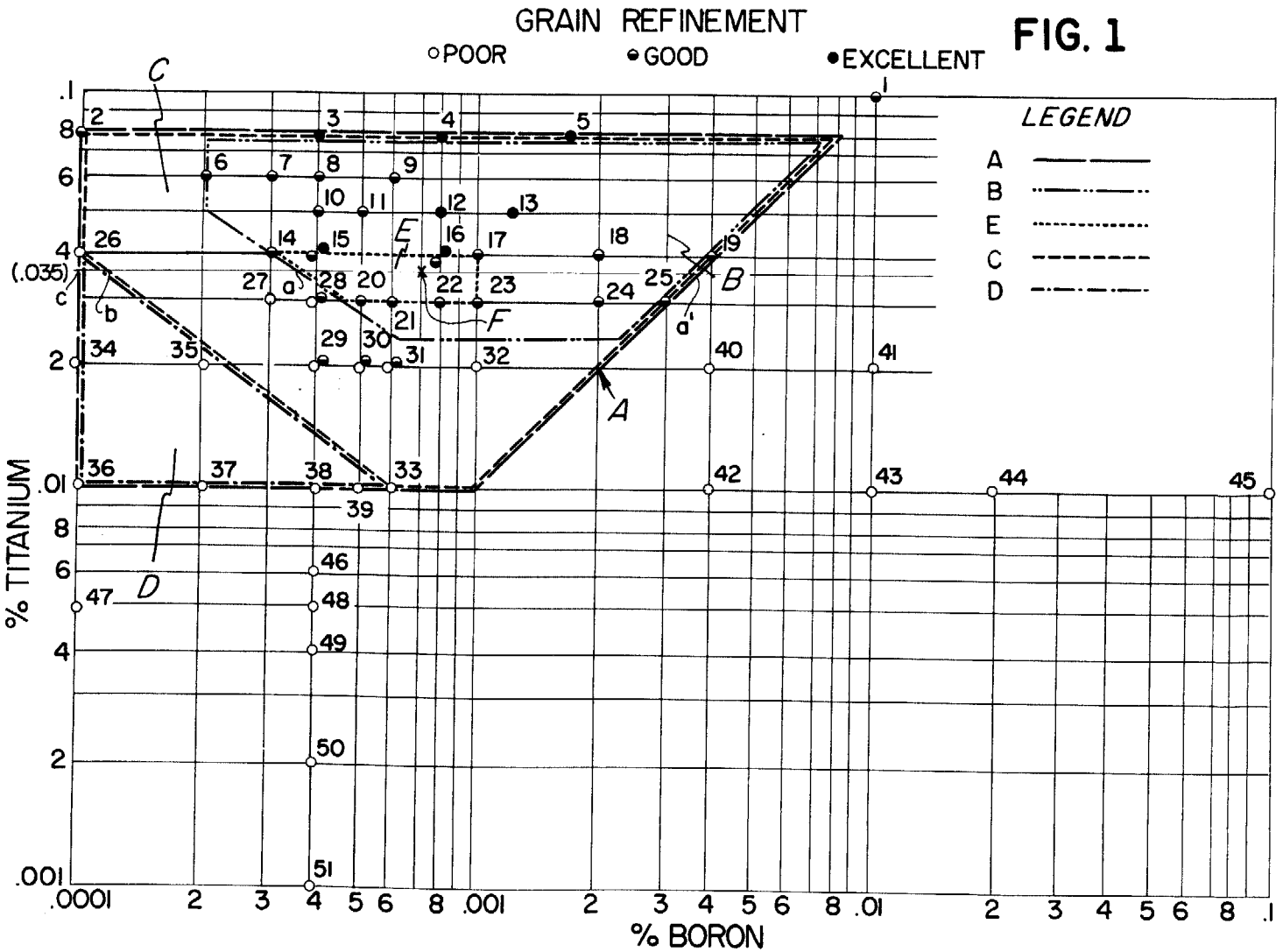

Grain refinement in Aluminum for additions made five minutes before Casting

Grain refinement in Aluminum for additions made five minutes before Casting a b c d e a b c d e

GRAIN REFINING OF ALUMINUM

This invention relates to a method and composition for grain refining of aluminum and aluminum base alloys including conventional aluminum alloys containing up to 15% by weight in the aggregate of the usual alloying elements, e.g. Mn, Cu, Mg, Cr, Zn, Si, Fe.

The grain size in aluminum castings, e.g. ingots, slabs and the like is an important industrial consideration and it is of advantage to provide a high degree of grain refinement in order to improve the workability of the castings, increase hot and cold strength, and avoid porosity which can result from the occurrence of large columnar grains.

It is known that the addition of titanium to molten aluminum provides a grain refinement in resultant castings. It is also indicated in the prior art that the presence of boron, together with titanium, in molten aluminum enhances grain refinement upon solidification due to the formation and presence of the refractory compound $TiB_2$. Revue de L'Aluminum December 1972, pp. 977–988, reports on the use of $KBF_4$ as the boron addition to a titanium treated aluminum bath wherein grain refinement occurred when $TiB_2$ was produced and identified. In the Journal of the Institute of Metals, Vol. 76, 1949/50 p. 321, it is contended that the refractory compound, $TiB_2$, acts as a nucleus for grain refinement. In Jern Kont Ann, 155, 1971, it is hypothesized that the grain is refined by the formation of $TiAl_3$ according to the reaction $$Al + TiB_2 \rightarrow Al + (TiAl)B_2 \rightarrow TiAl_3 + (TiAl)B_2.$$

The Journal of the Institute of Metals Vol. 98, 1970, page 23, offers the hypothesis that the presence of boron reduces the solid solubility of titanium in aluminum.

While it is known that boron will enhance grain refinement as indicated above, the presence of refractory $TiB_2$ compound particles in aluminum is undesirable in many instances, e.g. filtration systems for molten aluminum alloys are subject to plugging during casting and, during the working of aluminum castings, e.g. by flat rolling to foil gauges, the presence of hard intermetallic boride particles can act as stress raisers that lead to tears in the product.

It is accordingly an object of the present invention to provide a method for grain refining aluminum using titanium and relatively small amounts of boron.

It is another object of the present invention to provide a method for grain refining aluminum using an addition containing titanium and relatively small amounts of boron wherein molten aluminum can be cast almost immediately after the grain refiner addition.

It is another object of the present invention to provide a method for grain refining aluminum using an addition containing titanium and relatively small amounts of boron wherein the aluminum can be cast at a relatively long time after the grain refiner addition without substantial loss of grain refinement.

It is another object of the present invention to provide a method for grain refining aluminum using an addition containing titanium and boron wherein the resulting casting is substantially free from titanium boride detectable by light microscopy.

Other objects will be apparent from the following description and claims in conjunction with the drawing in which FIG. 1 shows a logarithm scale graph from which titanium and boron additions in accordance with the present invention can be determined.

Figure 2A:
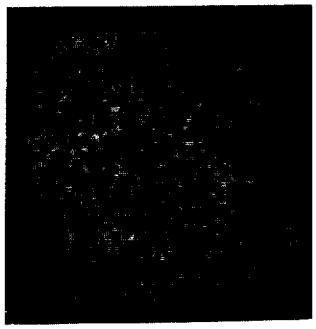
Figure 2B:
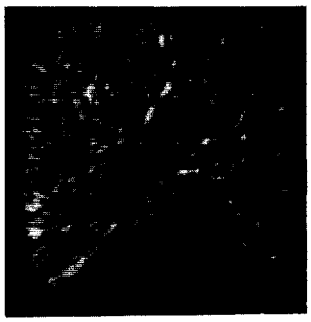
Figure 2C:
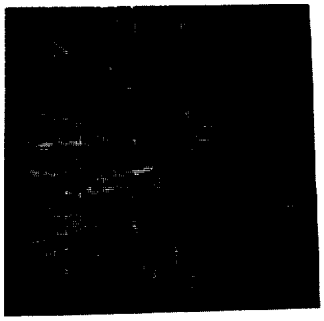

FIGS. 2*a*–2*c* show photographs illustrating different degrees of grain refinement in aluminum castings.

Figure 3:
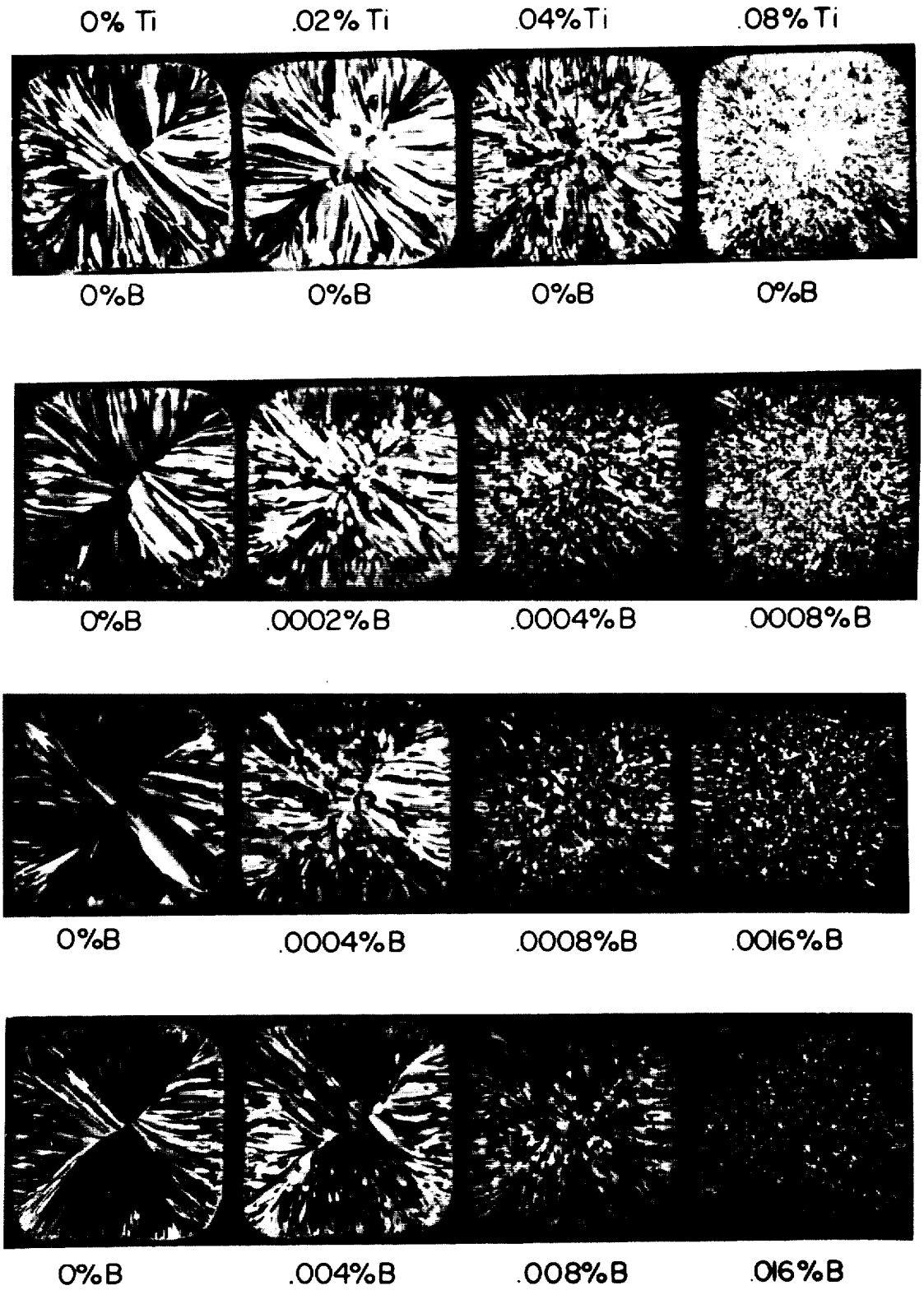

FIG. 3 shows further photographs illustrating various degrees of grain refinement in aluminum castings.

FIGS. 4*a*–4*e* show photographs of aluminum castings indicating the effect of different casting times on grain refinement.

FIGS. 5*a*–5*e* show photographs of aluminum castings indicating the effect of different casting times on grain refinement.

Figures 6A, 6B:
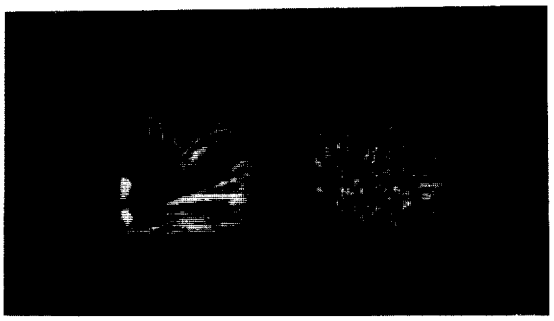

FIGS. 6*a* and 6*b* show photographs of aluminum castings indicating the effect of different times on grain refinement.

A method in accordance with the present invention for grain refining aluminum comprises adding to molten aluminum an addition in the form of a blended mixture consisting essentially of finely divided titanium, aluminum and potassium fluoborate, $KBF_4$; the aggregate amount of the titanium in the addition is at least about 0.005% by weight of the molten aluminum being treated and is in an amount sufficient to provide in the molten aluminum a percentage titanium content in the range of about 0.01 to 0.08%; the aggregate amount of $KBF_4$ in the addition is determinable on the basis of the titanium content in the molten aluminum as hereinafter described in conjunction with FIG. 1 of the drawing; and the aluminum content is from abour one-tenth to 4 times the weight of the titanium in the addition mixture.

The above-described addition can be in the form of a loose blended mixture, suitably confined in consumable containers with the titanium particle size being suitably 1.4 mm and finer and preferably 0.8 mm and finer. The aluminum particle size is suitably 2.4 mm(0.094 in.) and finer and preferably 1.4 mm (0.055 in.) and finer. The $KBF_4$ is suitably sized 0.2 mm (0.008 in.) and finer and preferably 0.1 mm (0.004 in.) and finer. In a particular embodiment of the invention, the blended mixture is in the form of compacts, e.g. pellets, produced by pressing together the above described powders suitably at pressures of from about 1.406 $Kgf/mm^2$ (2,000 psi) to 28.12 $Kgf/mm^2$ (40,000 psi). The compacts preferably have a thickness of not more than 22.23 mm (⅞ inches) to ensure optimum rapidity of solution.

In the practice of the present invention the addition in the form of a blended mixture of titanium, aluminum and $KBF_4$ dissolves rapidly in molten aluminum, solution of the addition being promoted by the intimate contact of aluminum particles with both the titanium and $KBF_4$ particles in the blended mixture, and the resulting aluminum castings exhibit grain refinement and no titanium boride particles can be observed at magnifications up to 1500X.

The present invention will be more fully understood with reference to FIG. 1 of the drawing which shows on a logarithm scale plot of % Ti by weight vs % B by weight, polygon (A) with enclosed regions (B), (C), (D), and (E). In determining an addition of Ti, B and Al for use as a grain refiner in accordance with the invention the desired % level of dissolved titanium for the molten metal to be cast is located on the ordinate of the graph of FIG. 1 and, for this titanium level, a % boron value intersecting with the titanium level within polygon (A) is selected. To obtain good or excellent grain refinement, for a molten metal holding period of about 5 minutes, i.e. the metal is cast 5 minutes after the addition, the boron level is selected from region (B); for holding periods of up to about 1 hour, region (C) can be used; for holding periods of up to about 2 hours and more region (D) can be used. A "holding period" of three hours will provide good or excellent grain refining anywhere in polygon (A) longer holding periods can be used if desired. With a % by weight boron chosen from within an appropriate region of polygon (A), the weight of boron corresponding thereto is converted to a weight of $KBF_4$ containing this amount of boron. This weight of $KBF_4$ is the amount for use in the grain refining addition in accordance with the present invention. In the event that the molten metal to be treated does not already contain any titanium in solution, the desired % of molten metal level for titanium, noted above, is converted to the corresponding amount by weight and this is the amount of titanium for use in the grain refining addition with the amount of $KBF_4$ determined as above. The amount of aluminum in the addition is from about one-tenth to 4 times the amount of titanium calculated as above. In instances where there is already, or will be before casting a % level of dissolved titanium in the molten metal from other sources, this % level is subtracted from the titanium level used in entering the graph of FIG. 1, and the resulting % difference is used in calculating the amount of titanium desired in the grain refining addition, the amount of aluminum being calculated on the basis of the amount of titanium desired in the addition.

EXAMPLE I

A mixture of elemental titanium, elemental aluminum and $KBF_4$ was prepared by conventionally blending substantially equal parts by weight of titanium powder (sized finer than 0.8 mm(0.031 in.)) and aluminum powder (sized finer than 0.2 mm (0.008 in.)) to obtain in the mixture the various titanium to boron, Ti/B weight ratios indicated in Table I for the various test samples 1-51. Portions of the blended mixtures were cold compacted at about 1.55 Kgf/mm² (2200 psi) to provide cylindrical compacts in the form of pellets about 9.5 mm (⅜ inch) in diameter by 3.2 mm (⅛ in.) to 12.7 mm (½ in.) long having a density of about 2.85 grams/cc.

The pellets were added to 1000 gram quantities of molten titanium-free (less than 0.0005% Ti) aluminum stabilized at a temperature of 760°C in a magnesia lined graphite crucible heated by a high frequency induction furnace. Pellet additions in an amount to provide particular titanium and boron contents in the molten aluminum were added to the molten aluminum. The pellets dissolved completely and rapidly (approximately 30 seconds) and there was no detected loss of titanium, aluminum or boron. At 5 minutes after the pellet addition, (5 minute holding period) the molten aluminum was cast into a 50.8 mm (2 in.) × 50.8 mm (2 in.) square and 230 mm (9.06 in.) long iron mold preheated to 215.5°C and the metal was allowed to solidify. Cross-section samples were cut 63.5 mm (2 ½ in.) from the bottom of the casting, polished etched in nitric + hydrochloric acid solution (1 part by volume $HNO_3$ to 2 parts by volume HCl) and examined for grain refinement. In Table I, "excellent" grain refinement was used to designate castings exhibiting more than 7500 grains per cc; "good" was used to designate castings exhibiting more than 3500 grains per cc but less than 7500; and "poor" was used to designate castings exhibiting less than 3500 grains per cc. The grains per cc were determined using the intercept method (Metals Handbook, page 416, 1948 Edition) and the number of grains in a cc calculated, assuming grains to be spherical. The determination of a "grain count" as described above is subject to a tolerance of as much as ± 20% and in making the designations as described above, grain counts close to the chosen classification numbers were listed in the lower classification. It is to be noted that the designations in Table I are based on metal cast after a 5 minute holding period. Samples 26 to 33 designated poor in Table I, for a holding period of five minutes with the same additions and a holding period of 1 hour or more become good or excellent; and samples 34 to 39 become good or excellent with a holding period of two hours or more.

Photographs (original magnification 1X) of cross-sections for samples 4, 15, and 29 of Table I are shown in FIGS. 2(a), 2(b), and 2(c) respectively. FIG. 2(a) shows excellent grain refinement (Grain Count of 8450 grains/cc); FIG. 2(b) shows good grain refinement (Grain Count of 5500 grains/cc); FIG. 2(c) shows poor grain refinement (Grain Count of 2350 grains/cc).

TABLE I

Grain Refinement of Ti-free Aluminum (99.9% Al) by the Addition of Ti-Al-$KBF_4$ Blended Powder Compacts-Holding Period of Five Minutes

| Sample | % Ti | % B | Ti/B | Grain Size | Region of FIG. 1 | Quality |
|---|---|---|---|---|---|---|
| 1 | 0.1 | 0.01 | 10/1 | | A-C-B | Good |
| 2(1) | 0.08 | 0.0000 | | 4250 grains/cc | A-C-B | Good |
| 3 | 0.08 | 0.0004 | 200/1 | | A-C-B | Excellent |
| 4 | 0.08 | 0.0008 | 100/1 | 7900 grains/cc | A-C-B | Excellent |
| 5 | 0.08 | 0.0016 | 50/1 | 8800 grains/cc | A-C-B | Excellent |
| 6 | 0.06 | 0.0002 | 300/1 | | A-C-B | Good |
| 7 | 0.06 | 0.0003 | 200/1 | | A-C-B | Good |
| 8 | 0.06 | 0.0004 | 150/1 | | A-C-B | Good |
| 9 | 0.06 | 0.0006 | 100/1 | | A-C-B | Good |
| 10 | 0.05 | 0.0004 | 125/1 | | A-C-B | Good |
| 11 | 0.05 | 0.0005 | 100/1 | 4191 grains/cc | A-C-B | Good |
| 12 | 0.05 | 0.0008 | 62.5/1 | | A-C-B | Excellent |
| 13 | 0.05 | 0.0012 | 41.6/1 | | A-C-B | Excellent |
| 14 | 0.04 | 0.0003 | 133/1 | | A-C-B | Good |
| 15(2) | 0.04 | 0.0004 | 100/1 | 5600 grains/cc | A-C-B | Good |
| 16(2) | 0.04 | 0.0008 | 50/1 | 6600 grains/cc | A-C-B | Good |
| 17 | 0.04 | 0.0010 | 40/1 | | A-C-B | Good |
| 18 | 0.04 | 0.0020 | 20/1 | | A-C-B | Good |
| 19 | 0.04 | 0.0040 | 10/1 | | A-C-B | Good |
| 20 | 0.03 | 0.0005 | 60/1 | | A-C-B | Good |

TABLE I-continued

Grain Refinement of Ti-free Aluminum (99.9% Al) by the Addition of Ti-Al-$KBF_4$ Blended Powder Compacts-Holding Period of Five Minutes

| Sample | % Ti | % B | Ti/B | Grain Size | Region of FIG. 1 | Quality |
|---|---|---|---|---|---|---|
| 21 | 0.03 | 0.0006 | 50/1 | 5950 grains/cc | A-C-B | Good |
| 22 | 0.03 | 0.0008 | 37.5/1 | | A-C-B | Good |
| 23 | 0.03 | 0.0010 | 30/1 | | A-C-B | Good |
| 24 | 0.03 | 0.0020 | 15/1 | | A-C-B | Good |
| 25 | 0.03 | 0.0030 | 10/1 | | A-C-B | Good |
| 26(1)(4) | 0.04 | 0.0000 | | 2250 grains/cc | C-A | Poor |
| 27(4) | 0.03 | 0.0003 | 100/1 | 2250 grains/cc | C-A | Poor |
| 28(3)(4) | 0.03 | 0.0004 | 75/1 | | C-A | Poor |
| 29(3)(4) | 0.02 | 0.0004 | 50/1 | 2300 grains/cc | C-A | Poor |
| 30(3)(4) | 0.02 | 0.0005 | 40/1 | | C-A | Poor |
| 31(3)(4) | 0.02 | 0.0006 | 33/1 | | C-A | Poor |
| 32(4) | 0.02 | 0.0010 | 20/1 | | C-A | Poor |
| 33(4) | 0.01 | 0.0006 | 16.6/1 | | C-A | Poor |
| 34(1)(5) | 0.02 | 0.0000 | | 1050 grains/cc | A-D | Poor |
| 35(5) | 0.02 | 0.0002 | 100/1 | 2200 grains/cc | A-D | Poor |
| 36(5) | 0.01 | 0.0001 | 100/1 | | A-D | Poor |
| 37(5) | 0.01 | 0.0002 | 50/1 | | A-D | Poor |
| 38(5) | 0.01 | 0.0004 | 25/1 | | A-D | Poor |
| 39(5) | 0.01 | 0.0005 | 20/1 | | A-D | Poor |
| 40 | 0.02 | 0.004 | 5/1 | | | Poor |
| 41 | 0.02 | 0.01 | 2/1 | | | Poor |
| 42 | 0.01 | 0.004 | 2.5/1 | | | Poor |
| 43 | 0.01 | 0.01 | 1/1 | | | Poor |
| 44 | 0.01 | 0.02 | 1/2 | | | Poor |
| 45 | 0.01 | 0.1 | 1/10 | | | Poor |
| 46 | 0.006 | 0.0004 | 15/1 | | | Poor |
| 47(1) | 0.005 | 0.0000 | | | | Poor |
| 48 | 0.005 | 0.0004 | 12.5/1 | | | Poor |
| 49 | 0.004 | 0.0004 | 10/1 | | | Poor |
| 50 | 0.002 | 0.0004 | 5/1 | | | Poor |
| 51 | 0.001 | 0.0004 | 2.5/1 | | | Poor |

Footnote Explanations (1)The additions for these samples did not contain any $KBF_4$ and are plotted adjacent 0.0001% B for convenience only.

(2)These samples are the net results of a multiplicity of individual heats of the same composition whose results are either good (3500 < grains/cc < 7500) or excellent (grains/cc > 7500). Because of composition. results, the minimum result, good, is applied to the sample composition.

(3)These samples are the net results of a multiplicity of individual heats of the same composition whose results are either poor (3500 > grains/cc) or good (3500 < grains/cc < 7500). Because of sporadic results, the minimum result, poor, is applied to the sample compostion.

(4)Samples 26 to 33, designated Poor in the Table, with the same addition, but with a holding time of one hour or more, become Good, or Excellent.

(5)Samples 34 – 39, designated Poor in the Table, with the same addition, but with a holding time of two hours or more, become Good or Excellent.

With further reference to FIG. 1, any addition mixture in accordance with the present invention containing Ti, Al and $KBF_4$ which provides a Ti and B contents defined within the polygon (A) will result in excellent or good grain refinement for holding periods of about 3 hours.

It is not necessary however that a holding period of at least 3 hours be used for all of polygon (A). Shorter holding periods are adequate for the various regions as described below. The enclosed region designated (B) in FIG. 1 is based upon the test data of Table I and represents a region of consistently good or excellent grain refinement through the practice of the present invention for metal cast about 5 minutes after an addition in accordance with the present invention. The region marked (E) represents a region of consistently good or excellent grain refinement with minimum optimum, desired titanium and boron through the practice of the present invention for metal cast after as brief a holding period as 5 minutes after an addition in accordance with the present invention. The region (C) represents a region of consistently good or excellent grain refinement through the practice of the present invention for metal cast about 1 hour after an addition in accordance with the present invention. The region (D) represents a region of consistently good or excellent grain refinement through the practice of the present invention for metal cast about two hours or more after an addition in accordance with the present invention. It is to be understood that longer holding periods than those mentioned above for the various regions can be used if desired.

The data of Table I and the graph of FIG. 1 indicate that generally less titanium and boron are required for good grain refinement for longer holding period.

In the practice of the present invention, in determining the addition to be made to a quantity of molten aluminum, the initial titanium content of the aluminum is determined and the amount of titanium required to provide a desired titanium content in the range of about 0.01% to 0.08% is calculated and this amount of titanium is used in the addition in accordance with the present invention. An amount of boron in the addition is determined from the graph of FIG. 1 corresponding to the desired %Ti content of the aluminum using the appropriate region of the graph. This % of boron is converted to an amount of $KBF_4$ which is blended with the determined amount of titanium, together with aluminum ranging one-tenth to 4 times the weight of the determined titanium amount. The resulting blended addition mixture is introduced into the molten aluminum.

In providing the amounts of titanium and boron in the manner noted above, from 100 to 120% of the determined amounts of titanium and $KBF_4$ can be suitably employed in the addition mixture.

The following hypothetical example "A" will further illustrate the practice of the present invention.

EXAMPLE A

Molten aluminum in the amount of 1000 lbs. contains 0.005% titanium in solution. It is desired to grain refine the aluminum at a titanium content of 0.035% titanium in the molten bath. The addition to the bath will contain (0.035%–0.005%) × 1000 lbs. = 0.3 lbs. of titanium. With reference to FIG. 1, to provide grain refining in metal cast about 5 minutes after an addition in accordance with the present invention, an addition can contain from about 0.00035% to 0.0035% ($a$ —$a'$) of the weight of the bath of boron, i.e. from about 0.0035 lbs. to 0.035 lbs. of boron. This amount of boron, in the form of $KBF_4$ is from about 0.041 lbs. to 0.41 lbs. For 100–120% of the desired boron, the $KBF_4$ can be from about 0.041 to 0.49 lbs. The aluminum in the addition can range from about 0.3 to 1.2 lbs. The foregoing addition is designed to provide grain refining in metal cast from the aluminum bath at a time of 5 minutes after the addition is made to the bath (Region (B)). A specific preferred addition in such a case would be about 0.3 lbs. Ti, 0.3 lbs. Al, 0.04 lbs. $KBF_4$ (Region (E)).

For the same bath weight and initial and desired titanium contents as above, for a casting time after addition of 1 hour the titanium content and aluminum content are the same and the boron content of the addition is from about 0.00012% to 0.0035% ($b$—$a'$) of the weight of the bath (Region (C)), i.e. from about 0.0012 lbs. to 0.035 lbs. of boron. This amount of boron, in the form of $KBF_4$ is from about 0.014 lbs. to about 0.41 lbs. of $KBF_4$. For 100–120% of the desired boron, the $KBF_4$ in the addition can range up to about 0.49 lbs.

For the same bath weight and initial and desired titanium contents as above, for a casting time after addition of two hours or more the titanium and aluminum contents are the same and the boron content is from about 0.0001% to 0.0035% ($c$ —$a'$) of the weight of the bath i.e. from about 0.001 lb. to 0.035 lbs. of boron. This amount of boron, in the form of $KBF_4$ is from about 0.011 lbs. of $KBF_4$ to about 0.41 lbs. of $KBF_4$. For 100–120% of the desired boron, the $KBF_4$ in the addition can range up to about 0.49 lbs.

With reference to FIG. 3, the photographs shown therein (50 mm (1.97 in.) × 50 mm (1.97 in.) sections) represent cross-sections of samples of aluminum cast after a 5 minute holding period. The samples in the left vertical row contained no boron or titanium and are reference "blanks". The samples of the top horizontal row contain no boron and illustrate that with a relatively high titanium content of 0.08% and no boron, good grain refinement is achieved. The second row from the top in FIG. 3, except for the blank, represents addition of Ti, Al and $KBF_4$ in accordance with the procedure of the Example (Samples 35, 15, 4 of Table I left to right) and show that with a boron content of as low as 0.0004%B, good grain refining is obtained with a 0.04% Ti content and excellent grain refining at 0.08%Ti. The third row from the top in FIG. 3, except for the blank, represents additions of Ti, Al and $KBF_4$ in accordance with the procedure of the Example (samples 29, 16 and 5 of Table I left to right) and show that with a boron content of 0.0008%, grain refinement is improved at 0.04% and 0.08% Ti content. The bottom row, except for the blank, represents additions of Ti and B in the form of a commercial titanium-boron alloy having a titanium to boron weight ratio of 5:1. With this type of boron addition, twenty times as much boron (0.008% and 0.016%) is required to provide good and excellent grain refinement as compared to the additions in accordance with the present invention (second row from top in FIG. 3).

Figure 4:
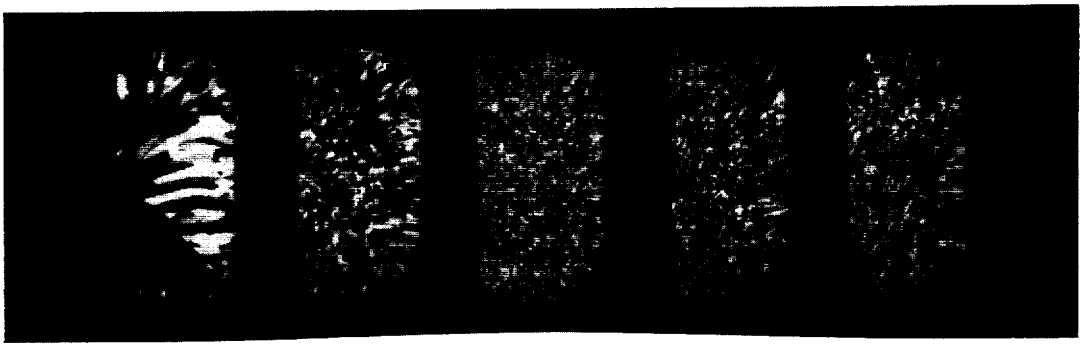
Figure 5:
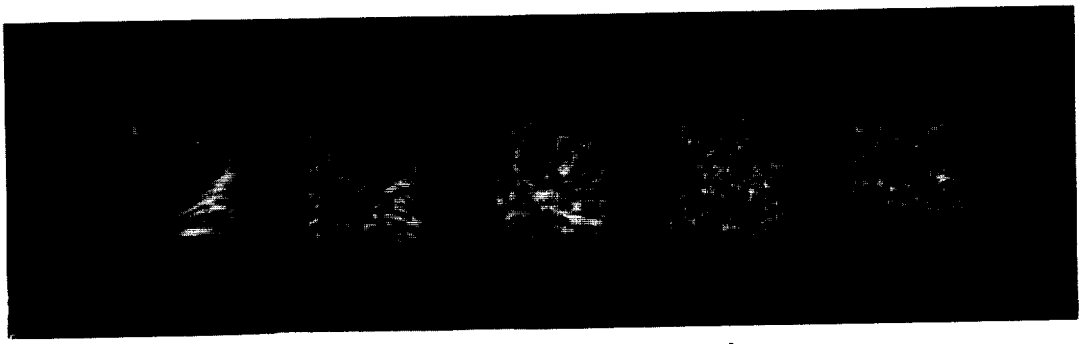

Table II shows data for additions made following the procedure of the Example, except for the holding periods, which are as set forth in Table II. Corresponding photographs of cross-sections (50 mm (1.97 in.) × 50 mm (1.97 in.) full section) are shown in FIGS. 4, 5 and 6. Table II and the photographs of FIGS. 4, 5 and 6 show that in the practice of the present invention, as the holding period is increased, the titanium content can be decreased while retaining grain refinement. For example, 0.01% Ti, 0.0001%B for a holding time of 180 minutes (FIG. 6 (b)) is as effective as 0.04% Ti, 0.0004%B at a holding period of 5 minutes.

TABLE II

| | | | | | |
|---|---|---|---|---|---|
| Ti, % | 0.00 | 0.04 | 0.04 | 0.04 | 0.04 |
| B, % | 0.00(Blank) | 0.0004 | 0.0004 | 0.0004 | 0.0004 |
| Holding Period | 5 Min. | 5 Min. | 10 Min. | 20 Min. | 30 Min. |
| Cross-Section | FIG. 4a | FIG. 4b | FIG. 4c | FIG. 4d | FIG. 4c |
| Ti, % | 0.02 | 0.02 | 0.02 | 0.02 | 0.02 |
| B, % | 0.0004 | 0.0004 | 0.0004 | 0.0004 | 0.0004 |
| Holding Period | 5 Min. | 30 Min. | 60 Min. | 90 Min. | 120 Min. |
| Cross-Section | FIG. 5a | FIG. 5b | FIG. 5c | FIG. 5d | FIG. 5e |
| Ti, % | 0.00 | 0.01 | | | |
| B, % | 0.00(Blank) | 0.0001 | | | |
| Holding Period | 180 Min. | 180 Min. | | | |
| Cross-Section | FIG. 6a | FIG. 6b | | | |

The addition of the present invention can contain up to 50% by weight in the aggregate of finely divided Mn, Fe, Cr, W, Mo, V, Co, Cu, Ni, Cb, Ta, Si, Zr, Hf and Ag and alloys of these elements. The addition agent of the present invention may also contain minor proportions of compounds such as alkali metal flouride. A particular advantage of the present invention is that detectable particles of titanium boride, $TiB_2$, do not result from grain refining in accordance with the present invention. Examination of castings at magnifications up to 1500X did not show any $TiB_2$ particles. This means that with the grain refining method of the present invention there is no danger on account of refractory boride particles clogging molten metal filtering equipment or damaging rolls or other equipment used in working the cast metal or in tearing of metal during rolling to thin sheet.

In a further embodiment of the present invention an addition agent is provided consisting essentially of finely divided titanium, aluminum and $KBF_4$ wherein the titanium, and boron contents $KBF_4$ are in proportions which intersect in region (E) of FIG. 1 and the aluminum content is from about one-tenth to four times the amount of the titanium content. The use of such addition agents to provide a titanium content in molten aluminum of from about 0.03 to 0.08 per cent will provide good or excellent grain refining in metal cast 5 minutes or more after the addition. The addition agent is preferably in the form of compacts pressed from powders as aforedescribed. An example of an addition agent in this range, point F in FIG. 1, would contain 350 parts of titanium, 83 parts $KBF_4$ and 35 parts aluminum.

What is claimed is:

1. A method for grain refining aluminum which comprises a. providing a bath of molten aluminum base metal b. making an addition to the bath of molten aluminum in the form of a blended mixture consisting essentially of finely divided titanium, aluminum and $KBF_4$, the aggregate amount of titanium in the addition being at least about 0.005% by weight of the molten metal and being in an amount sufficient to provide in the molten bath a percentage titanium content selected from the range of about 0.01 to 0.08%, the aggregate amount of $KBF_4$ in the addition being such as to contain boron in an amount equivalent to a percentage of the molten bath falling within the polygon (A) of the graph of FIG. 1 of the drawing corresponding to the selected percentage of titanium, the amount of aluminum being from about one-tenth to 4 times the weight of titanium in the mixture.

2. A method in accordance with claim 1 wherein the amount of boron in the mixture is determined from region (B) of FIG. 1.

3. A method in accordance with claim 1 wherein the amount of boron in the mixture is determined from the region (C) of the graph of FIG. 1.

4. A method in accordance with claim 1 wherein the amount of boron in the mixture is determined from the region (D) of the graph of FIG. 1.

5. A method in accordance with claim 1 wherein the amount of boron in the mixture is determined from the region (E).

6. An addition agent for refining aluminum, base metal consisting essentially of compacted blended mixture of titanium, aluminum and $KBF_4$ wherein the titanium and boron contents are in proportions which intersect in region (E) of FIG. 1 and the aluminum content is from about one-tenth to 4 times the amount of the titanium content.

* * * * *

UNITED STATES PATENT OFFICE
CERTIFICATE OF CORRECTION

Patent No. 3,933,476 Issue Date January 20, 1976

Inventor(s) K.S. Chopra, et al.

It is certified that error appears in the above-identified patent and that said Letters Patent are hereby corrected as shown below:

In footnote (2) of Table I on the page containing columns 5 and 6 after "of" at line 2 of footnote (2) change "composition" to --sporadic--.

Signed and Sealed this

Seventh Day of September 1976

[SEAL]

*Attest:*

RUTH C. MASON
*Attesting Officer*

C. MARSHALL DANN
*Commissioner of Patents and Trademarks*